United States Patent [19]

Varga

[11] Patent Number: 4,739,170

[45] Date of Patent: Apr. 19, 1988

[54] PLASMA GENERATOR

[75] Inventor: Istvan K. Varga, Windsor Gardens, Australia

[73] Assignee: The Commonwealth of Australia, Canberra, Australia

[21] Appl. No.: 12,004

[22] PCT Filed: May 7, 1986

[86] PCT No.: PCT/AU86/00128

§ 371 Date: Jan. 9, 1987

§ 102(e) Date: Jan. 9, 1987

[87] PCT Pub. No.: WO86/06922

PCT Pub. Date: Nov. 20, 1986

[30] Foreign Application Priority Data

May 9, 1985 [AU] Australia ..... PH00494

[51] Int. Cl.[4] ..... H01J 27/00

[52] U.S. Cl. ..... 250/427; 250/423 R; 250/251; 315/111.81

[58] Field of Search ..... 250/423 R, 426, 427, 250/452.21, 251; 313/359.1; 315/111.21, 111.41, 111.81

[56] References Cited

U.S. PATENT DOCUMENTS

| | | | |
|---|---|---|---|
| 2,837,693 | 6/1958 | Norton | 313/359.1 |
| 3,155,593 | 11/1964 | Warnecke et al. . | |
| 3,660,715 | 5/1972 | Post | 315/111 |
| 3,999,072 | 12/1976 | Takagi | 250/427 |
| 4,213,043 | 7/1980 | Dawson | 250/427 |
| 4,468,564 | 8/1984 | Boyer et al. | 250/427 |
| 4,645,977 | 2/1987 | Kurokawa et al. | 315/111.21 |
| 4,661,710 | 4/1987 | Verney et al. | 250/423 R |
| 4,682,026 | 7/1987 | Douglas | 250/423 R |

FOREIGN PATENT DOCUMENTS

| | | |
|---|---|---|
| 959150 | 10/1962 | United Kingdom . |
| 1348562 | 3/1974 | United Kingdom . |

*Primary Examiner*—Bruce C. Anderson

*Attorney, Agent, or Firm*—Cushman, Darby & Cushman

[57] ABSTRACT

Plasma generator which is constructed and operated to provide an enhanced probability of collisions between charged and neutral particles in the working chamber together with enhanced energy transfer and uniformity of the plasma. The plasma generator includes a chamber (1) with means to produce electrons (5) and to cause the electrons to rotate and spiral (6,7) to produce ion of gases introduced into the chamber to produce a plasma. The plasma is contained by magnetic mirrors (10,11) at each end of the chamber (2). Axial oscillation of the plasma is produced by a low frequency oscillating potential (9) in the chamber to significantly increased ion electron interaction.

10 Claims, 2 Drawing Sheets

PLASMA GENERATOR

Figure 1:
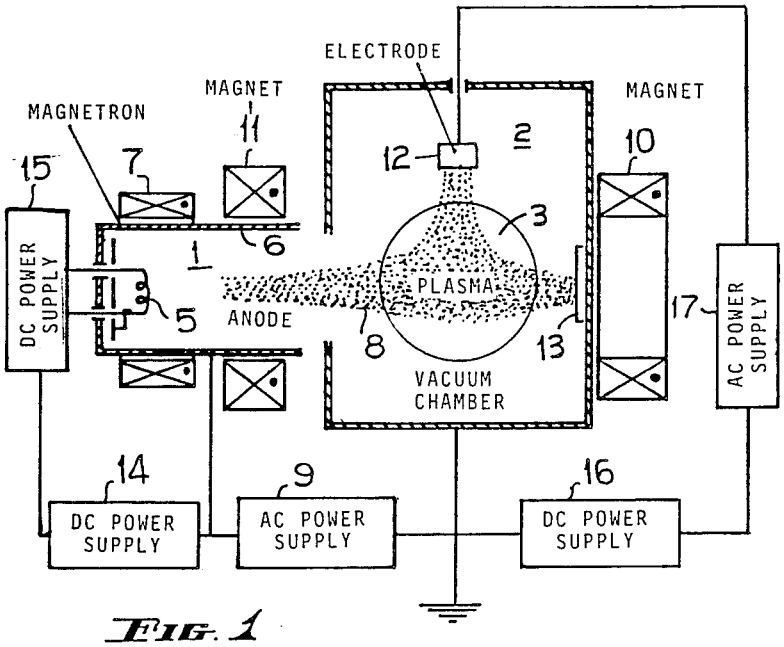

This invention relates to a technique which is used to expand and intensify a plasma from a source region into a working chamber.

In the last two decades, but particularly in recent years, significant developments have taken place in the area of plasma generation. These have been prompted by a usefulness of plasmas in all aspects of semiconductor technology and by an ever increasing number of new applications. Some of the areas where a plasma, or its separated charged particles are used are ion sources, ion rockets, nuclear physics, heavy-ion science, ion plating, crystal growth (ion beam epitaxy), synthesis of compound materials (plasma polymerization, reactive sputtering), ion sputtering activated reactive evaporation, surface analysis, medical applications, surface treatment, ion-assisted thin film deposition, lasers and many others.

As an example of the art reference may be had to the Proceedings of the International Engineering Congress—ISIAT'83 and IPAT'83 Kyoto (1983) in which a plasma system is described which is used for plasma oxidation of silicon surfaces as used in VLSI production, but the present invention has many applications.

Also reference may be had to the specification of U.S. Pat. No. 3,660,715 of Richard F. Post assigned to the United States Energy Commission which relates to a plasma generator using a stack of pulsed washers to release, ionize and heat the gas.

An object of the present invention is to provide a plasma generating device of simple construction and ease of operation and which allows an enhanced collision probability between charged and neutral particles in the working chamber together with enhanced energy transfer and uniformity of the plasma.

The invention consists of a plasma generator which allows both electrons and ions to oscillate in an applied field at low frequency excitation with electrons and ions moving in opposite directions.

According to this invention a plain cylindrical magnetron communicates with a chamber and both are pumped through by a high vacuum pumping system, the magnetron having means to produce electrons and including magnetic means to cause the electrons to rotate and spiral and ionise gas atoms or molecules introduced to the magnetron to produce plasma, characterised by means to establish an axial oscillation of electrons and ions in opposite direction, the means comprising magnetic mirror means at the outlet of the magnetron adjacent to the chamber and further magnetic mirror means at the opposite side of the chamber whereby to increase significantly ion electron interaction to facilitate multiple ionization and additionally to enhancement of neutral particle ionization, the chamber having in it an electrode adjacent to the plasma field which is polarised to produce either an electrically neutral or positive or negative stream of charged particles.

Figure 2:
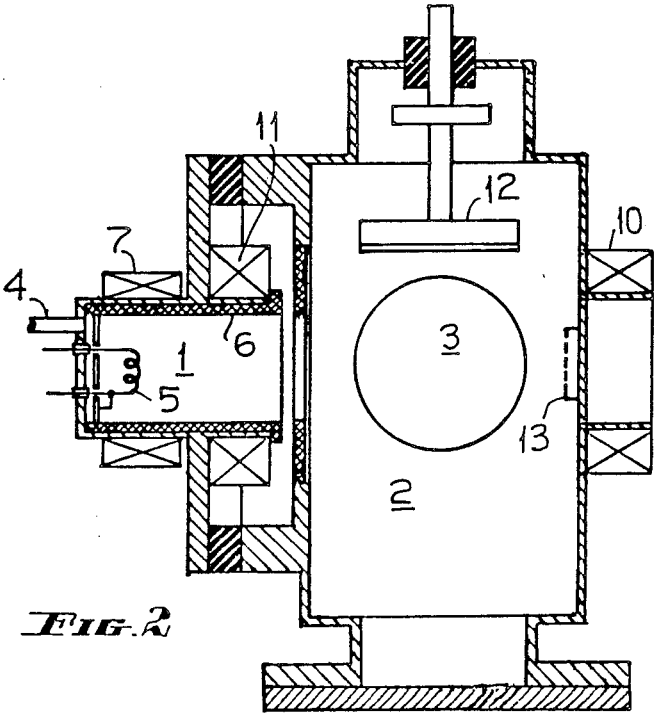
Figure 3:
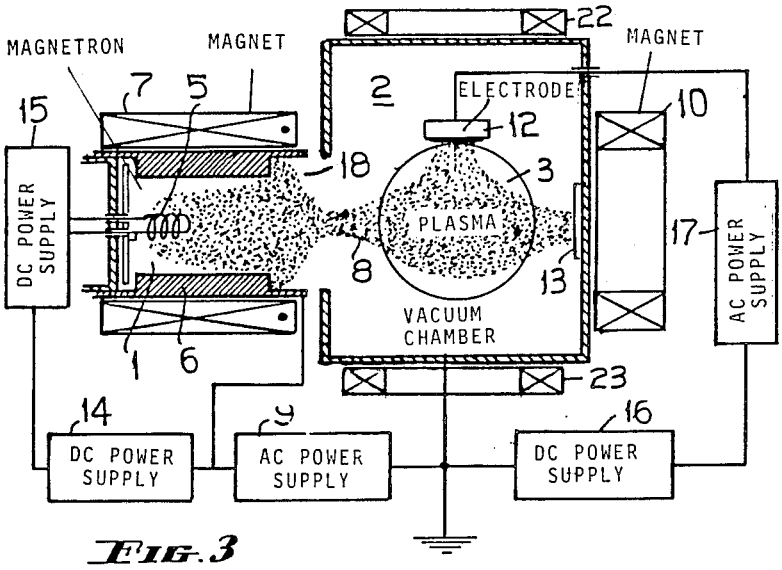
Figure 4:
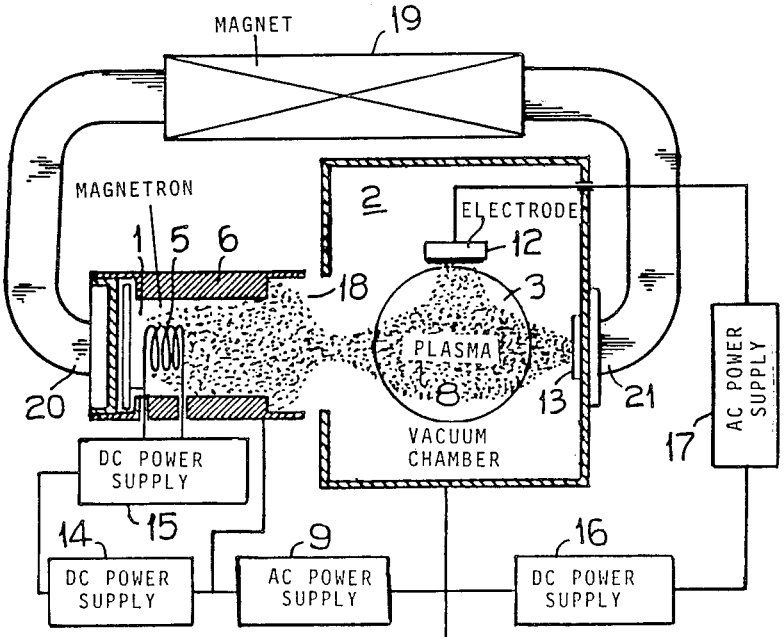

To enable the invention to be fully understood, it will now be described with reference to the accompanying drawings which show various forms of the invention and in which:

FIG. 1 is a schematic diagramatic view of one form of the invention using three magnets with one magnet related particularly with the magnetron and two magnets positioned one each side of the chamber to form the magnetic mirror means across the chamber, the drawing including block diagrams to show the method of establishing the axial of electrons and ions in opposite direction, FIG. 2 is a somewhat schematic transverse section of the invention, FIG. 3 is a view corresponding to FIG. 1 but showing a two magnet system, and FIG. 4 shows in a view similar to FIG. 1 in which a single magnet is used.

Referring first to FIGS. 1 and 2, the two main components of the source are a plain cylindrical magnetron 1 and a vacuum chamber 2. The vacuum chamber 2 and the magnetron 1 are pumped through the opening 3 by a conventional high vacuum pumping system.

The materials to be ionized are introduced into the system through inlet 4 in a gas or vapour form.

The initial ionization takes place in the plain cylindrical magnetron 1, which has an electron source 5, provided by a heated tungsten or tantalum or other filament placed at or near the magnetron axis, a cylindrical anode 6 and an axial magnet 7 forming a magnetic field Electrons emitted from the filament are confined radially and prevented by the magnetic field from reaching the anode 6. The rotating and spiralling energetic electrons ionise gas atoms or molecules present in the magnetron 1, forming a confined plasma 8, which persist as long as suitable conditions are maintained.

According to this invention, the intensity of the plasma is increased by establishing an axial oscillation of electrons and ions. This may be achieved if consideration is given to the rate at which ions may respond to axial forces. Generally, with respect to electrons in a plasma, ions are considered stationary or of low mobility due to their very much larger mass compared to electrons. However, we have found that if a suitable low frequency potential is applied along the magnetron axis, both electrons and positive ions can be made to oscillate axially. Negative ions, which are the result of electron attachment, also move in opposite direction to the movement of the positive ions so that these are also subjected to collision with the positive ions. Ions achieve no nett movement if a high frequency potential is applied.

The nature of this mass transport is such that particles with opposite charge polarity will move in opposite directions under the influence of the applied potential and this transportation mode will increase significantly the probability of ion-electron and ion-ion interaction, facilitating ionised molecule fracture and multiple ionization in addition to an enhancement of neutral particle ionization.

The frequency used may depend on the nature of the ions but with gas ions produced by admitting Hydrogen, Argon, Nitrogen, Methane or other similar gases or vapours to the magnetron, it has been found that a frequency of oscillation of 50 Hz is effective, but the frequency can be selected over a wide range. Beyond 1 MHz ions are unaffected by the applied field.

To facilitate the energy transfer described above the magnetron 1 vacuum chamber 2 combination is used as shown in FIG. 2, where the low frequency voltage is applied between the magnetron 1 and the vacuum chamber 2 by the AC power supply 9 as indicated in FIG. 1. To contain the plasma and also to enhance further the process of ionization a magnetic field in the form of a magnetic mirror is formed by the field of magnet 10 and 11 as shown in FIGS. 1 and 2. The magnet 7 of the magnetron also forms a magnetic mirror with magnet 11.

While the magnetic mirrors have little or no effect on the ions they largely control electron trajectories under static conditions. However, when the axial potential variation is applied above a certain voltage value, the electrons will move in an axial direction with sufficient energy to ionize additional gas particles. They will alternately move between the magnetron 1 and the vacuum chamber 2 as driven by the low frequency voltage gradient of the AC power supply 9. Similarly the positive ions are made to move by the same potential variation in the opposite direction to that of electrons or negative ions.

As was mentioned earlier the result of interaction of the charged particles with each other or with neutral atoms or molecules generates more ionised particles, which will also be influenced by the low frequency axial potential.

The chamber 2 has in it electrodes 12 and 13.

In the arrangement shown, the vacuum chamber 2 is at earth potential and the magnetron chamber wall is connected through the AC power supply 9 to have the necessary low frequency applied thereto, a DC power supply 14 supplying the current for the filament 5 through the DC filament supply unit 15.

A DC power supply 16, acting through an AC power supply 17, energises the electrode 12, these units be such as to allow both voltage and frequency selection at the electrode 12 for relative deposition.

In FIG. 3 the magnet 7 of the magnetron extends to terminate adjacent to the chamber 2 so that the magnetron magnet is common to the chamber.

In this figure is shown optionally how the electrical coupling between this magnetron and the chamber 2 can be increased by providing an intermediate volume 18 for plasma extension.

In FIG. 4 a single magnet 19 is used having one pole 20 adjacent the outer end of the magnetron and its other pole 21 adjacent to the side of the chamber 2 remote from the magnetron.

In FIGS. 3 and 4 similar components are similarly numbered.

The electrodes 12 and 13 may support substrates for there film deposition from ionic state under suitable bias potential conditions.

When a series of DC and AC voltage combinations is used for the extraction of ionized particles, the phase of the AC extraction potential must be out of phase of the axial low frequency potential by 180° and the same frequency potential should be used.

While the plasma in the chamber can be maintained by using a suitable DC voltage between the magnetron and the chamber, the plasma tends to spread into the gas supply line, but this does not happen with AC excitation.

It is found that AC excitation together with the DC plus AC extraction provides a simple way to overcome possible surface and space charge accumulation on and near substrates exposed to the electrically charged particle stream.

It is possible, as shown in FIG. 3, but applicable to each embodiment, to use a suitable cross magnetic mirror field as generated between the two magnets 22 and 23, or a single magnet as used in FIG. 4 could provide a transverse field, to further enhance the plasma generation.

Features of this plasma generator are:

(1) Its simplicity of structure, easy operation and uniform plasma excitation at pressures in the 10-4 Torr range.

(2) The low frequency excitation allows not only the electrons, but also the ions to oscillate at the applied field frequency, increasing the probability of collision between charged particles and neutrals, thus increasing the energy transfer to the plasma and the uniformity of the plasma.

(3) The plasma confinement as arranged reduces loss of the plasma, at the same time allows easy access for utilization of the plasma.

(4) There are a number of ways to achieve interaction between probes and electrodes and the plasma, of which two examples are given by the electrode 12 and the electrode 13. Electrode 12 can be extended to form a continuous cylinder or a larger number of electrodes or extractors.

(5) The extraction of ionized particles is achieved by a series of DC and AC voltage combination, applied to an electrode such as 12 as shown particulatly in FIG. 2, that can provide either an electrically neutral, positive or negative stream of particles as desired.

What is claimed:

1. A plasma generator adapted to be evacuated, and opening to a chamber (2) a magnetron (1) having a cylindrical anode (6) and an axial magnet (7) to form a confined plasma (8) said chamber (2) including an electrode (12–13) at the plasma field, characterised by magnetic means (10–11) effective at each side of the said chamber (2) and coaxial with the cylindrical anode (6) and polarised to form a magnetic mirror field, further characterised by means (9) to apply an axial potential to the electrons and ions of the plasma (8) of a frequency low enough to establish an axial oscillation of the heavier ions with electrons and ions moving in opposite directions in the magnetic mirror field, whereby to facilitate multiple ionization and enhancement of neutral particle ionization, further characterised by means (16–17) to polarize said electrode (12–13) to produce either an electrically neutral or positive or negative beam of charged particles.

2. A plasma generator according to claim 1 wherein the said low frequency axial potential is applied between the said anode (6) and the said chamber (2).

3. A plasma generator according to claim 1 wherein the said magnetron (1) receives its electron supply from a filament (5) connected to a DC power source (15) which is biased by a further DC source (14) connecting it to the said anode (6) of the magnetron (1).

4. A plasma generator according to claim 1 wherein the said electrode (12–13) at the plasma field is energised by an AC power source (17) biased by a DC power source (16) connected between the said AC power source (17) and the said chamber (2).

5. A plasma generator according to claim 1 wherein the magnetic mirror at the magnetron (1) side of the said chamber (2) is common to the magnetron (1).

6. A plasma generator according to claim 1 wherein a single magnet (19) is used having one pole (20) adjacent to the end of the magnetron (1) remote from the chamber (2) and the other pole (22) adjacent the chamber (2) remote from the magnetron (1).

7. A plasma generator according to claim 1 wherein a magnetic mirror field is applied through the chamber (2) at right angles to the axis of the plasma generator (1) and at the centre of the first magnetic mirror field by magnet means (22–23).

8. A plasma generator according to claim 1 wherein the chamber (2) includes an intermediate volume (18).

9. The method of producing a plasma which consists in exciting a gas in a magnetron directed into an evacuated chamber, forming a magnetic mirror by means of opposite polarity magnetic fields disposed one on one side of the said chamber and the other on the other side of the said chamber about the axis of the said magnetron, applying an oscillating field between the anode of said magnetron and said chamber of a frequency low enough to oscillate both ions and electrons and of a voltage high enough to drive ions and electrons through the magnetic field between the said magnetron and the said chamber, and applying a biased field to an electrode in said chamber whereby to produce either an electrically neutral or positive or negative beam of charged particles.

10. The method of producing a plasma according to claim 9 which includes applying a further magnetic mirror field through the chamber at right angles and central to the magnetic mirror field existing in the chamber, to further enhancing plasma generation.

* * * * *